US009021624B2

(12) United States Patent
Wu

(10) Patent No.: US 9,021,624 B2
(45) Date of Patent: May 5, 2015

(54) LAVATORY PAN DEVICE AND NON-WATER LAVATORY FLUSHING SYSTEM WITH THE DEVICE

(76) Inventor: Hao Wu, Beijing (CN)

( * ) Notice: Subject to any disclaimer, the term of this patent is extended or adjusted under 35 U.S.C. 154(b) by 819 days.

(21) Appl. No.: 13/319,732

(22) PCT Filed: May 19, 2010

(86) PCT No.: PCT/CN2010/000705

§ 371 (c)(1),
(2), (4) Date: Nov. 10, 2011

(87) PCT Pub. No.: WO2010/133089

PCT Pub. Date: Nov. 25, 2010

(65) Prior Publication Data

US 2012/0054951 A1 Mar. 8, 2012

(30) Foreign Application Priority Data

May 19, 2009 (CN) ..... 2009 2 0154685 U

(51) Int. Cl.

| | |
|---|---|
| ***A47K 11/03*** | (2006.01) |
| ***E03D 5/014*** | (2006.01) |
| ***E03D 5/10*** | (2006.01) |

(52) U.S. Cl.
CPC . *E03D 5/014* (2013.01); *E03D 5/10* (2013.01)

(58) Field of Classification Search
CPC ..... A47K 11/026
USPC ..... 4/471, 449–486
See application file for complete search history.

(56) References Cited

FOREIGN PATENT DOCUMENTS

CN 1690319 A * 11/2005

* cited by examiner

*Primary Examiner* — Lori Baker

(57) ABSTRACT

A lavatory pan device for separating stool and urine includes a stool and urine tray, a supporting device, and a moment force producing device. The stool and urine tray consists of a flat plate and the rib inclining upward and extending outward from the whole or partial edge of the flat plate. The lavatory pan has an opening or an entry way at the longitudinal side and is connected on the supporting device. Through the moment force produced by the prescribed moment force producing device, the stool and urine tray can roll over on the supporting device. The described moment force producing device is set on the stool and urine tray and it is between tow supports of the above supporting device and the opening or entry way.

10 Claims, 7 Drawing Sheets

LAVATORY PAN DEVICE AND NON-WATER LAVATORY FLUSHING SYSTEM WITH THE DEVICE

FIELD OF INVENTION

The invention generally relates to a lavatory flushing device, detailedly, it relates to a lavatory pan device for stool and urine and a lavatory non-water flushing system with the above device. The device has the flushing pump, but doesn't use water as the flushing liquid.

BACKGROUND OF INVENTION

The PCT international application with the same applicant of this invention has the Publication Number CN101103157A. It published a lavatory non-water flushing device with the flushing pump. The device includes a human body detective device, a circuit control device, a lavatory pan, a crushing and centrifugal device, an upper flushing liquid flushing pump, a flushing liquid collecting box, a stool collecting box, a automatic deodorant liquid adding device. The crushing and centrifugal device includes a crushing cutter head and a centrifugal blade wheel, which are fixed on the same peripheral axis, and a motor for driving the rotating axis. The crushing and centrifugal device is fixed at the valley of the lavatory pan for collecting the stool. The upper flushing liquid flushing pump is fixed at the inside or outside of the flushing liquid collecting box for the purpose of pumping the upper flushing liquid out. The outlet of the upper flushing pump of the flushing liquid is connected with the fore part of the lavatory pan through a pipe. The invention, characterized in, consists of an electric control four-port valve. One entrance of it is connected with the outlet of the side wall of the back valley of the lavatory pan for collecting stool. The three outlets are respectively connected with the middle part of the lavatory pan, the stool collecting box and the flushing liquid collecting box through a stool crushing pipe, a stool collecting pipe and a urine collecting pipe. With a four-way valve, the said device replaced the electric control valve of the stool crushing pipe, the electric control valve of the stool collecting pipe and the electric control valve of the urine collecting pipe of the lavatory flushing device, which is published in the PCT application (Publication Number WO02/26764) with the same applicant of the invention. The above device controls the crushed stool and urine liquid in the stool crushing pipe, stool collecting pipe and the urine collecting pipe respectively. It cancels the four-way joint. This not only simplifies the structure and saves the cost, but also resolves the problem of wrong flow direction of the retained liquid thoroughly. And it avoids the stool plasm flowing into the flushing liquid collecting box and the limited clean urine liquid discharges through the stool collecting pipe. This is advantaged to improve the flushing effect. But the above device still has these disadvantages:

It makes the structure of the device complicated by using the stool and urine identifying software program to determine the stool or urine by calculating the length of time that the users entering the lavatory. And it also can make mistakes, such as considering the urine as stool and this will waste the flushing liquid.

When flushing the stool and urine, the crushing and centrifugal device should be started, and this makes the structure of the device complicated and makes the crushing and centrifuging procedure very dirty. If the hard property drops into it accidentally, the crushing and centrifugal device will be destroyed.

DESCRIPTION OF INVENTION

The invention can solve the problems of the present lavatory with flushing pump, for example, the structure of the non-water flushing device is too complicated and the misjudge of stool and urine, the destroy of machine member as the hard property dropping into the stool and urine. The invention provides a lavatory pan for stool and urine and the non-water flushing lavatory with the above device.

The lavatory pan device for stool and urine of the invention includes a stool and urine tray, a supporting device, a moment force producing device. The stool and urine tray consists of a flat plate and a guard rib inclining upward and extending outward from the whole or partial edge of the flat plate. The lavatory pan has an opening or an entry way at the longitudinal side and is connected on the supporting device. Through the moment force produced by the prescribed moment force producing device, the stool and urine tray can roll over on the supporting device. The described moment force producing device is set on the lavatory pan of stool and urine and it is between tow supports of the above supporting device and the opening or an entry way at the longitudinal side of the said stool and urine tray.

Preferably, an elbow pipe with an entry way or a funnel with an entry way is generated at the longitudinal side of the stool and urine tray without the guard rib.

The described moment force producing device can use the gravity deviation structure, electromagnetic structure, air-powered structure or mechanical-driven structure. Thus, the said moment force producing device is not limited to the above structure, it can also use other structure that could realize its functions.

A non-water lavatory flushing device with the above lavatory pan consists of a stool pan, an upper flushing liquid flushing device, a middle upper flushing liquid flushing device. Wherein, an upper flushing outlet is located at the upper part of the stool pan and a stool discharging tube is at the bottom. The upper flushing liquid flushing device includes an upper flushing liquid box, a air pump, a deodorant liquid pot and a deodorant liquid valve. The upper flushing liquid flushing device has a cylinder which is extended from its head cover to lower part. The outlet of the air pump is connected with the inner of the upper flushing liquid box at the lower part of it through the pipeline. One end of a pipeline is connected with the inner of the upper flushing liquid box through the head cover of the upper flushing liquid box and the other end is connected with the upper flushing outlet of the lavatory pan. The inner of the deodorant liquid pot is connected with the inner of the upper flushing liquid box through the pipeline and the deodorant liquid valve is fixed on the said pipeline. The middle flushing liquid flushing device includes a stool collecting box, a deodorant liquid pot and a deodorant liquid valve. The inner of the deodorant liquid pot is connected with the inner of the stool collecting box through pipeline and the deodorant liquid valve is fixed on the said pipeline. The above lavatory pan device is fixed at the lower part of the stool discharging tube of the lavatory pan. The lower part of the stool discharging tube is in the stool and urine tray. There is a gap between the upper surface of the flat plate of the stool and urine tray and the end face of the lower part of the stool discharging tube. Or the described lavatory pan device is fixed at the lower part of the stool discharging tube of the stool pan and the part of the end face of the lower part of the stool discharging tube can contact with the part of the guard rib of the stool and urine tray closely. The upper flushing liquid box is located at the lower part of the outlet or one side of the entry way of the stool and urine tray and the stool collecting box is located at the other part of it.

Afterwards, the prescribed upper flushing liquid flushing device also includes an upper flushing liquid flushing pump and a upper flushing liquid valve. The said upper flushing liquid flushing pump and upper flushing liquid valve are set at the pipeline of the upper flushing outlet used for connecting the upper flushing liquid box and the lavatory pan.

Preferably, there is a middle flushing outlet at the middle of the lavatory pan. A filter board is set in the stool collecting box. The filter board divides the inner of the stool collecting box into two sides, one is for stool and urine, the other is for middle flushing liquid. The above middle flushing liquid flushing device includes a middle flushing liquid flushing pump, whose inlet is connected with the middle flushing liquid side of the inner of the stool collecting box through the pipeline and the outlet is connected with the middle flushing outlet of the lavatory pan by the pipeline.

Furthermore, as the outlet of the upper flushing liquid flushing pump is connected with the outlet of the middle flushing liquid flushing pump, and then it is also connected with the upper flushing outlet or the middle flushing outlet.

Afterwards, the upper and middle flushing liquid flushing pump are all the foot pump. The deodorization liquid valve is manual. Otherwise, the upper and middle flushing liquid flushing pump are electric centrifugal pumps or the electric plunger pumps and the deodorization liquid valve is an electric control valve. The upper and middle flushing liquid flushing pump and the deodorization liquid valve are controlled by the electric switches.

More preferably, the described non-water lavatory flushing device also consists of a human detective device, a stool and urine tray condition detector and a circuit control device. The said circuit control device is connected with the human detective device, the stool and urine tray condition detector, the upper flushing liquid flushing pump, the middle flushing liquid flushing pump and the deodorization liquid valve. The said human detective device can detect the time that the user enters and leaves the lavatory and send the message to the circuit control device. The said stool and urine tray condition detector can judge the stool or urine and send the result to the circuit control device. As the circuit control device receives the message of the user's leaving sent by the human detective device, it will control the starting and stopping of the upper flushing liquid flushing pump, the middle flushing liquid flushing pump and the deodorization liquid valve according to the judgment of the stool and urine tray condition detector.

Thereinto, the described human detective device is the photoelectric detective device or passive human infrared detective device mounted under the floorboard of the lavatory. Or it could be a pressure transmitter set under the floorboard of the lavatory. And it also could be a travel switch that is mounted on the lock or inserted pin of the lavatory door. The described stool and urine tray condition detector is mounted on the stool discharging tube of the lavatory pan. Certainly, other kind of device could be used on the human detective device if all the function could be realized.

Preferably, the said stool collecting box is connected with the stool storage and transportation tank through a pipeline, and a stool discharging pump and a stool discharging valve are set on the said pipeline. The lower part of the upper flushing liquid box is connected with the lower part of the stool collecting box by a connecting pipe.

Thereinto, the prescribed device producing the moment of force is a balance weight block, or it could be an extension spring. One end of the said spring is connected with the lavatory pan and the other end is connected with the top of the stool collecting box. Or the prescribed the moment of force producing device consists of a permanent-magnet and a iron block mating it. The said iron block is mounted on the lavatory pan and the above permanent-magnet is set on the top of the stool collecting box.

In the prescribed upper flushing liquid flushing device, the deodorization liquid pot has the deodorization foam liquid which is produced by mixing the deodorization liquid and the blister.

A non-water lavatory flushing device with the prescribed pan device consists of a lavatory pan, an upper flushing liquid flushing device, a middle flushing liquid flushing device. There is an upper flushing outlet on the top of the lavatory pan and a stool discharging tube at the bottom of it. The upper flushing liquid flushing device includes an upper flushing liquid box, an upper flushing liquid flushing pump, a deodorization liquid pot and a deodorization liquid valve. The inlet of the upper flushing liquid flushing pump is connected with inner of the upper flushing liquid box by a pipeline and the outlet of it is connected with the upper flushing outlet of the stool pan by a pipeline. The inner of the deodorization liquid pot is connected with the upper flushing liquid box by a pipeline and the deodorization liquid valve is mounted on the said pipeline. The middle flushing liquid flushing device includes a stool collecting box, a deodorization liquid pot and a deodorization liquid valve. The inner of the deodorization liquid pot is connected with the stool collecting box by a pipeline and the deodorization liquid valve is set on the said pipeline. The prescribed lavatory pan device is mounted at the lower part of the stool discharging tube of the lavatory pan and the lower part of the stool discharging tube is in the stool and urine tray. There is a given space between the upper surface of the plate of the stool and urine tray and the end face of the lower part of the stool discharging tube. Otherwise, the pan device is mounted on the lower part of the stool discharging tube of the lavatory pan and part of the end face of the lower of it could be contacted with part guard rib of the stool and urine tray closely. The upper flushing liquid box is at the outlet of the stool and urine tray or lower part of one side of the pathway and stool collecting box is at the outlet of the stool and urine tray or lower part of the other side of the pathway.

The lavatory pan of the invention has simple structure and can judge the stool or urine correctly.

The non-water lavatory flushing device of the invention cancelled the pulverizing and centrifugal device of the prior art and this avoids the dirty pulverizing and centrifugation procedure. The invention uses the stool and urine tray device to replace the stool and urine identification software of the prior art to judge the stool or urine and this could make the structure of the device simple, but also could avoid the judging mistakes, such as judging the urine as stool, and avoid the waster of the flushing liquid.

The non-water lavatory flushing device of the invention, still characterized in:

There is a middle flushing outlet at the middle part of the stool pan. A filter board is set in the stool collecting box and it divides the inner of the stool collecting box into two sides, one is for stool and the other is for middle flushing liquid. The middle flushing liquid flushing device includes a middle flushing liquid flushing pump, whose inlet is connected with the middle flushing liquid side of the stool collecting box through a pipeline. And the outlet of the middle flushing liquid flushing pump is connected with the middle flushing outlet of the stool pan by a pipeline.

The upper flushing liquid flushing pump and middle flushing liquid flushing pump are foot pumps. The deodorization liquid valve is hand valve.

The upper and middle flushing liquid flushing pump are electric centrifugal pump or electric plunger pump and the deodorization liquid valve is a electric control valve. The upper and middle flushing liquid flushing pump and the deodorization liquid valve are controlled by the electric switch.

The non-water lavatory flushing device also includes a human detective device, a circuit control device and a stool and urine tray condition detector. The human detective device is set in the lavatory and the stool and urine tray condition detector is mounted at the stool discharging tube of the stool pan. The upper and middle flushing liquid flushing pump are electric centrifugal pumps or electric plunger pumps and the deodorization liquid valve is an electric control valve. The circuit control device is connected with the human detective device, stool and urine tray condition detector, the upper flushing liquid flushing pump, the middle flushing liquid flushing pump and the deodorization liquid valve electrically.

The non-water lavatory flushing device also includes a human detective device, a circuit control device and a stool and urine tray discharging device. The human detective device is set in the lavatory and the stool and urine tray condition detector is mounted at the stool discharging tube of the stool pan. The upper and middle flushing liquid flushing pump are electric centrifugal pumps or electric plunger pumps and the deodorization liquid valve is an electric control valve. The circuit control device is connected with the human detective device, the stool and urine tray discharging device, the upper flushing liquid flushing pump, the middle flushing liquid flushing pump and the deodorization liquid valve electrically.

DETAILED DESCRIPTION OF THE EMBODIMENTS

Figure 1:
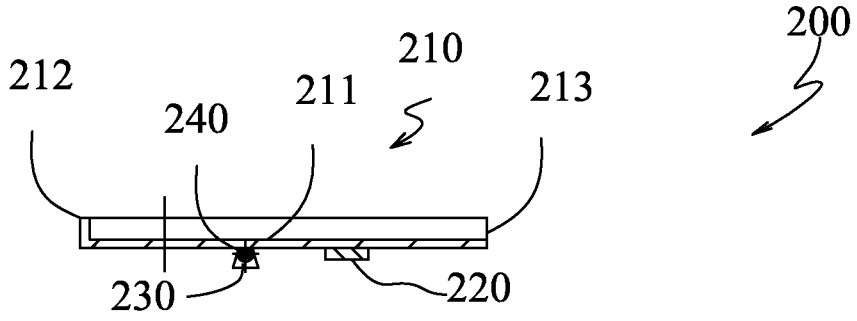
FIG. 1 is the longitudinal section diagrammatic sketch of a kind of lavatory pan device for stool and urine.

Following is the detailed description of embodiments of the invention referring to the drawings, and the advantages and characteristics of the invention will become more and more obviously.

Figure 2:
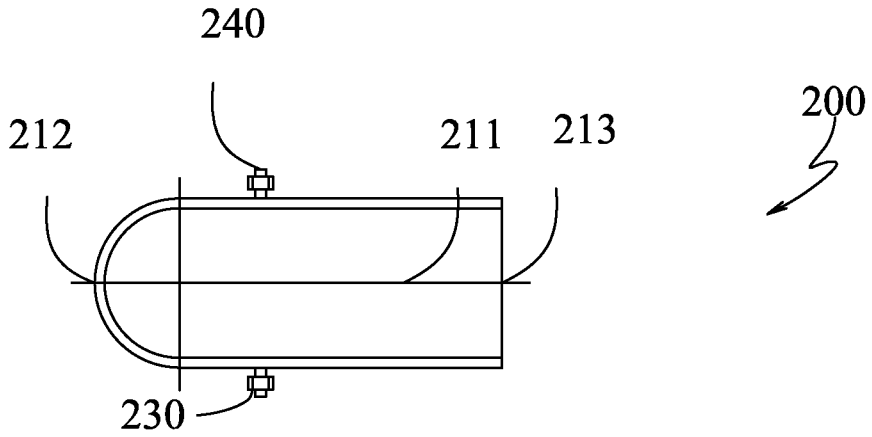
FIG. 2 is the overhead diagrammatic sketch of the lavatory pan device for stool and urine as shown in FIG. 1.

As shown in FIG. 1 and FIG. 2, the first kind of lavatory pan device 200 for stool and urine of the invention consists of a stool and urine tray 210, a balance weight block 220, two supporting stands 230 and an axis 240. The stool and urine tray 210 is composed by a flat plate 211 and a guard rib 212 extending and inclining upward and outward from the edges of there sides of the flat plate 211. At the other side of stool and urine tray 210 where no guard rib 212 is generated, a outlet 213 appears. The axis 240 is fixed on the bottom of the flat plate 211 of the stool and urine tray 210 and there is a distance away from the outlet 213. The balance weight block 220 is also fixed at the bottom of the flat plate 211 of the stool and urine tray 210 and there is a distance away from the axis 240 and it is near the outlet 213 of the stool and urine tray 210. The two ends of axis 240 are supported rotatably in the two supporting stands 230. The axis 240 could be generated as a whole body with the stool and urine tray 210, for example, the part of the external wall of the two transversal ribs 212 of the stool and urine tray 210 respectively extend transversally and the two ends of the axis, which has the same longitudinal central line, are generated.

Figure 3:
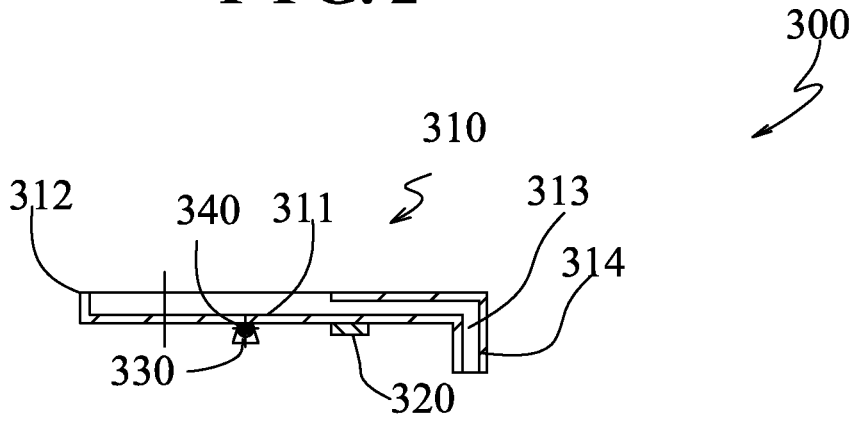
FIG. 3 is the longitudinal section diagrammatic sketch of the second kind of lavatory pan device for stool and urine.
Figure 4:
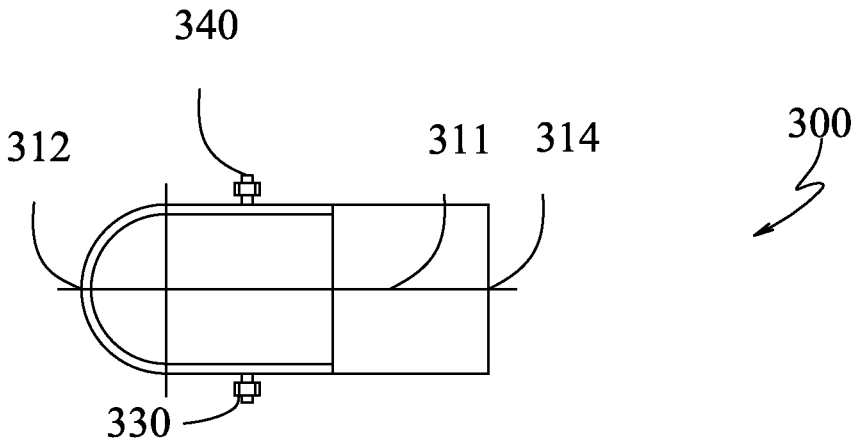
FIG. 4 is the overhead diagrammatic sketch of the lavatory pan device for stool and urine as shown in FIG. 3.

As shown in FIG. 3 and FIG. 4, the second kind of lavatory pan device 300 for stool and urine consists of a stool and urine tray 310, a weight block 320, two supporting stands 330 and an axis 340. The stool and urine tray 310 is composed by a flat plate 311 and a guard rib 312, which inclines and extends upwards and outwards from three edges of the flat plate 311. At the other edge of stool and urine tray 310 where no guard rib 312 is generated, there is an elbow pipe 314 with a channel 313. The axis 340 is fixed on the bottom of the flat plate 311 of the stool and urine tray 210 and there is a distance away from the channel 313. The balance weight block 320 is also fixed at the bottom of the flat plate 311 of the stool and urine tray 210 and there is a distance away from the axis 340 and it is near the channel 313 of the stool and urine tray 310. The two ends of axis 340 are supported rotatably in the two supporting stands 330. The axis 340 could be generated as a whole body with the stool and urine tray 310, for example, the part of the external wall of the two transversal ribs 312 of the stool and urine tray 310 respectively extend transversally and the two ends of the axis, which has the same longitudinal central line, are generated.

Figure 5:
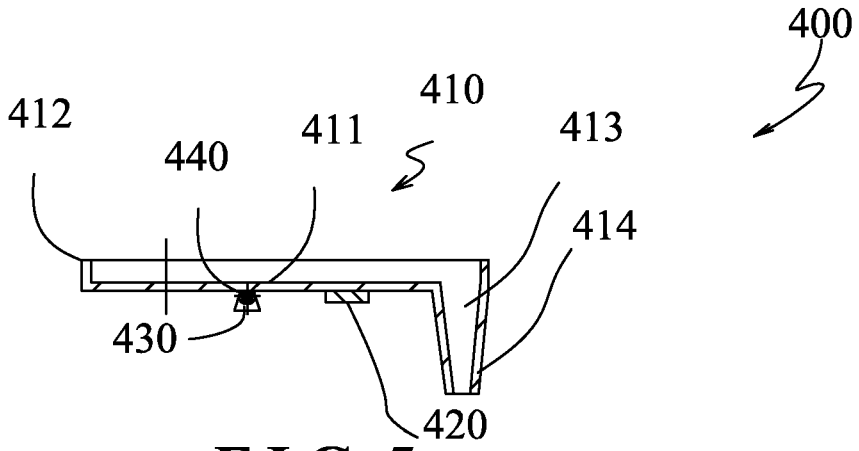
FIG. 5 the longitudinal section diagrammatic sketch of the third kind of lavatory pan device for stool and urine.
Figure 6:
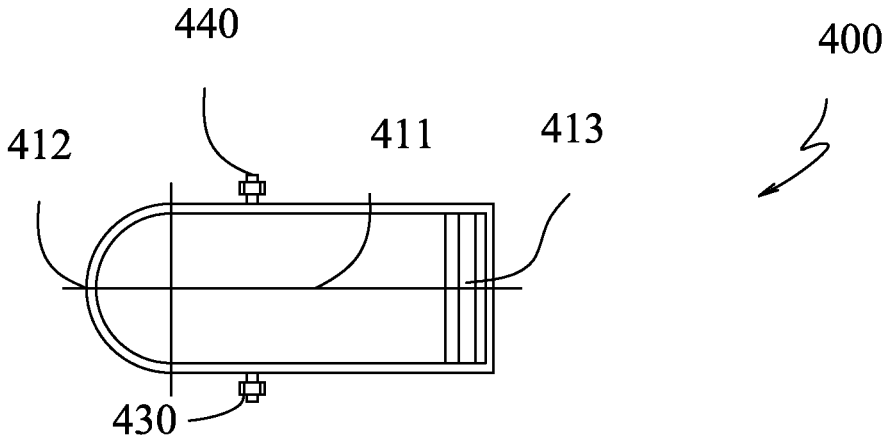
FIG. 6 is the overhead diagrammatic sketch of the lavatory pan device for stool and urine as shown in FIG. 5.

As shown in FIG. 5 and FIG. 6, the third kind of lavatory pan device 400 for stool and urine of the invention consists of a stool and urine tray 410, a weight block 420, two supporting stands 430 and an axis 440. The stool and urine tray 410 is composed by a flat plate 411 and a guard rib 412, which inclines and extends upwards and outwards from four edges of the flat plate 411. A hopper 414 with a channel 413 is generated at the corresponding part of the stool and urine tray 310 where the elbow pipe 314 appears. The axis 440 is fixed on the bottom of the flat plate 411 of the stool and urine tray 410 and there is a distance away from the channel 413. The balance weight block 420 is also fixed at the bottom of the flat plate 411 of the stool and urine tray 410 and there is a distance away from the axis 440 and it is near the channel 313 of the stool and urine tray 310. The two ends of axis 440 are supported rotatably in the two supporting stands 430. The axis 440 could be generated as a whole body with the stool and urine tray 410, for example, the part of the external wall of the two transversal ribs 412 of the stool and urine tray 410 respectively extends transversally and the two ends of the axis, which has the same longitudinal central line, are generated.

Figure 7A:
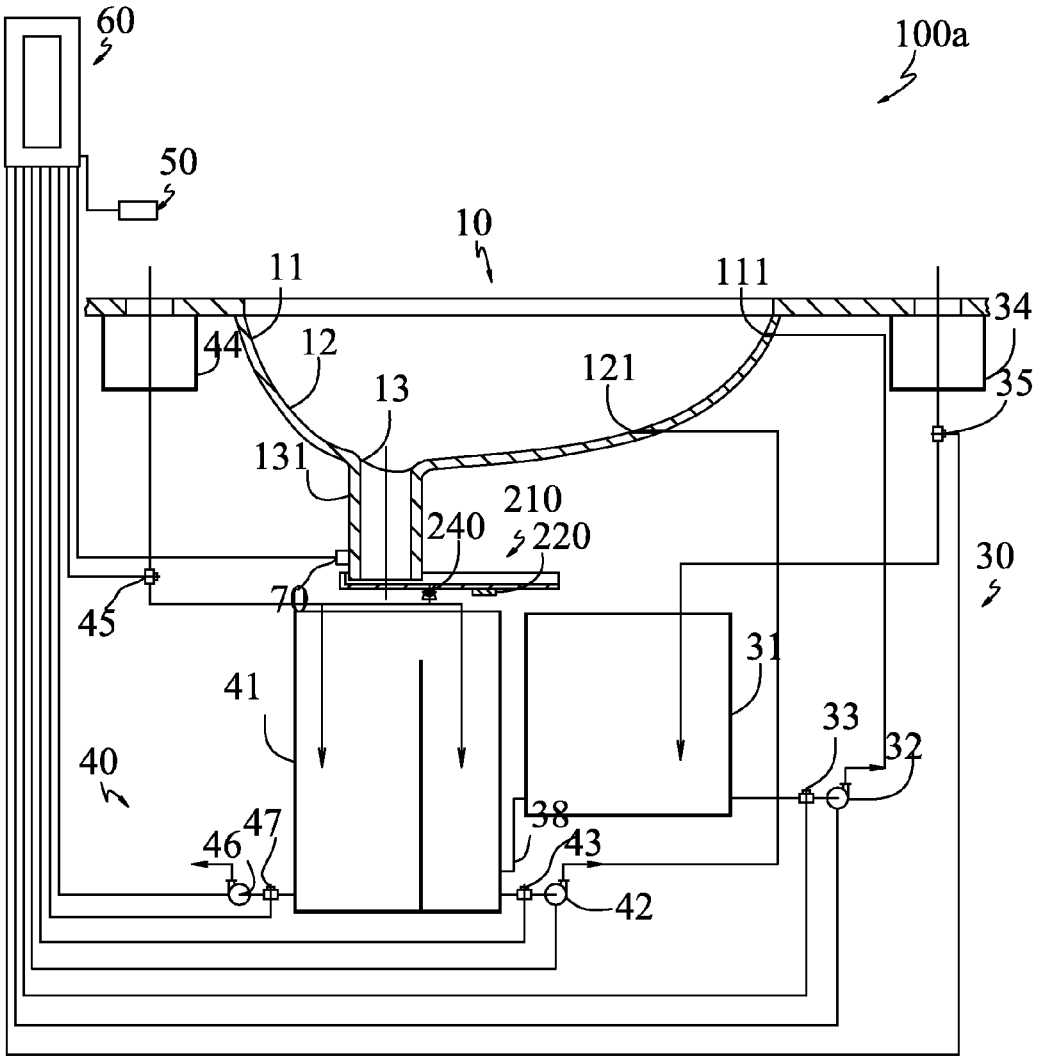
FIG. 7*a* is the longitudinal section diagrammatic sketch of the first embodiment of the first kind of lavatory pan device for stool and urine of the non-water lavatory flushing device in the situation of urine of the invention.
Figure 7B:
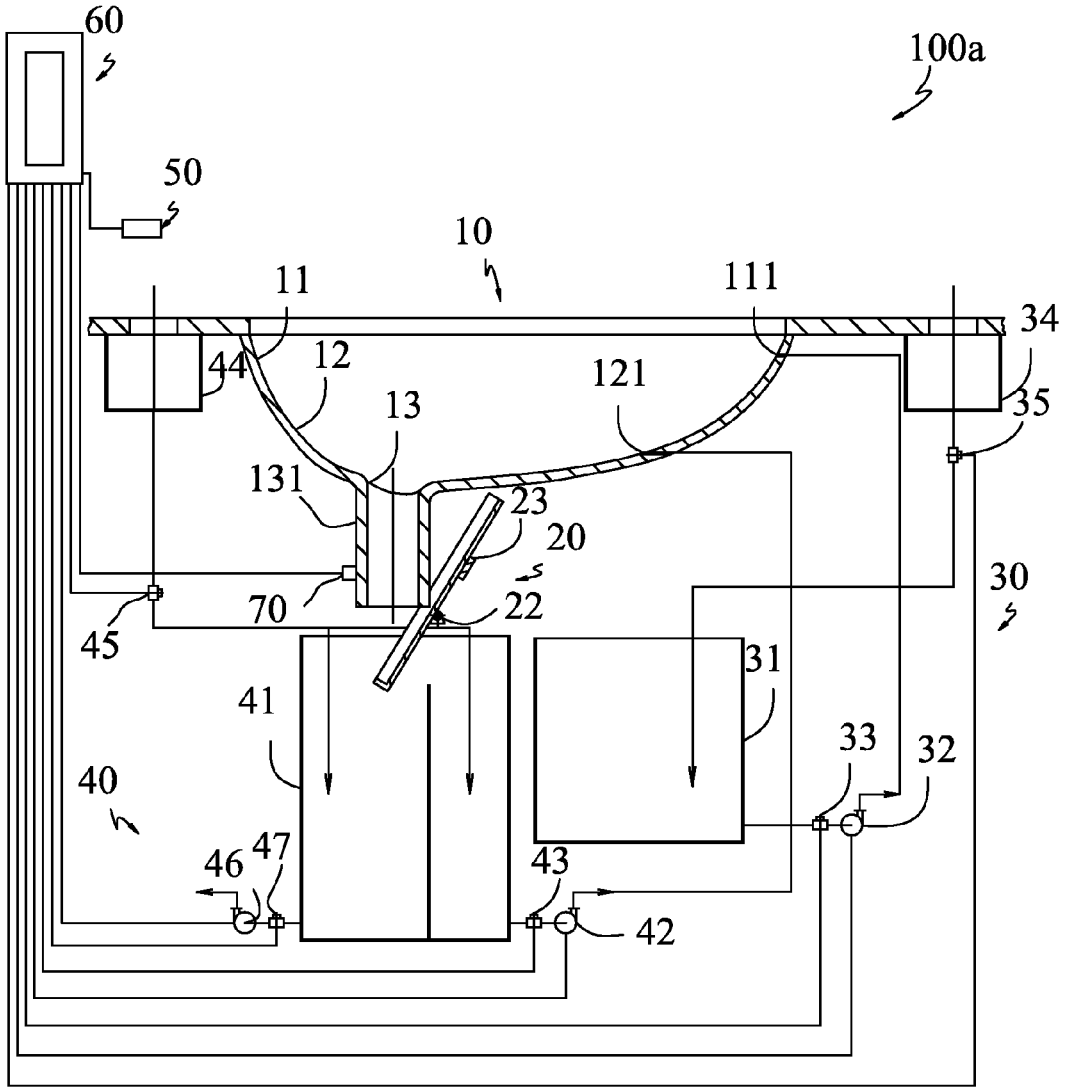
FIG. 7*b* is the longitudinal section diagrammatic sketch of the first embodiment of the first kind of lavatory pan device for stool and urine of the non-water lavatory flushing device in the situation of stool of the invention.

As shown in FIG. 7*a* and FIG. 7*b*, the non-water lavatory flushing device 100*a*, the first embodiment of the first kind of lavatory pan device 200 for stool and urine of the invention, consists of a lavatory pan 10, the said stool and urine tray device 200 (or the said stool and urine tray device 300, or the said stool and urine tray device 400), an upper flushing liquid flushing device 30, a middle flushing liquid flushing device 40, a human body detective device 50, a circuit control device 60 and a stool and urine tray condition detector 70.

The lavatory pan 10 has the upper part 11, the middle part 12 and the bottom part 13. The upper part 11 has an upper flushing outlet 111, and the middle part 12 has the middle flushing outlet 121, and the bottom part 12 has a stool discharging tube 131. The lavatory pan 10 could be squatting pan or sitting pan.

The stool and urine tray device 200 is mounted at the lower part of the stool discharging tube 131 of the lavatory pan 10. The lower part of the stool discharging tube 131 is set in the stool and urine tray 210. There is a distance between the upper surface of the flat plate 211 and the end face of the lower end of the stool discharging tube 131. The stool and urine tray condition detector 70, for example, a position switch, is mounted on the stool discharging tube 131 of the lavatory pan 10.

Figure 8:
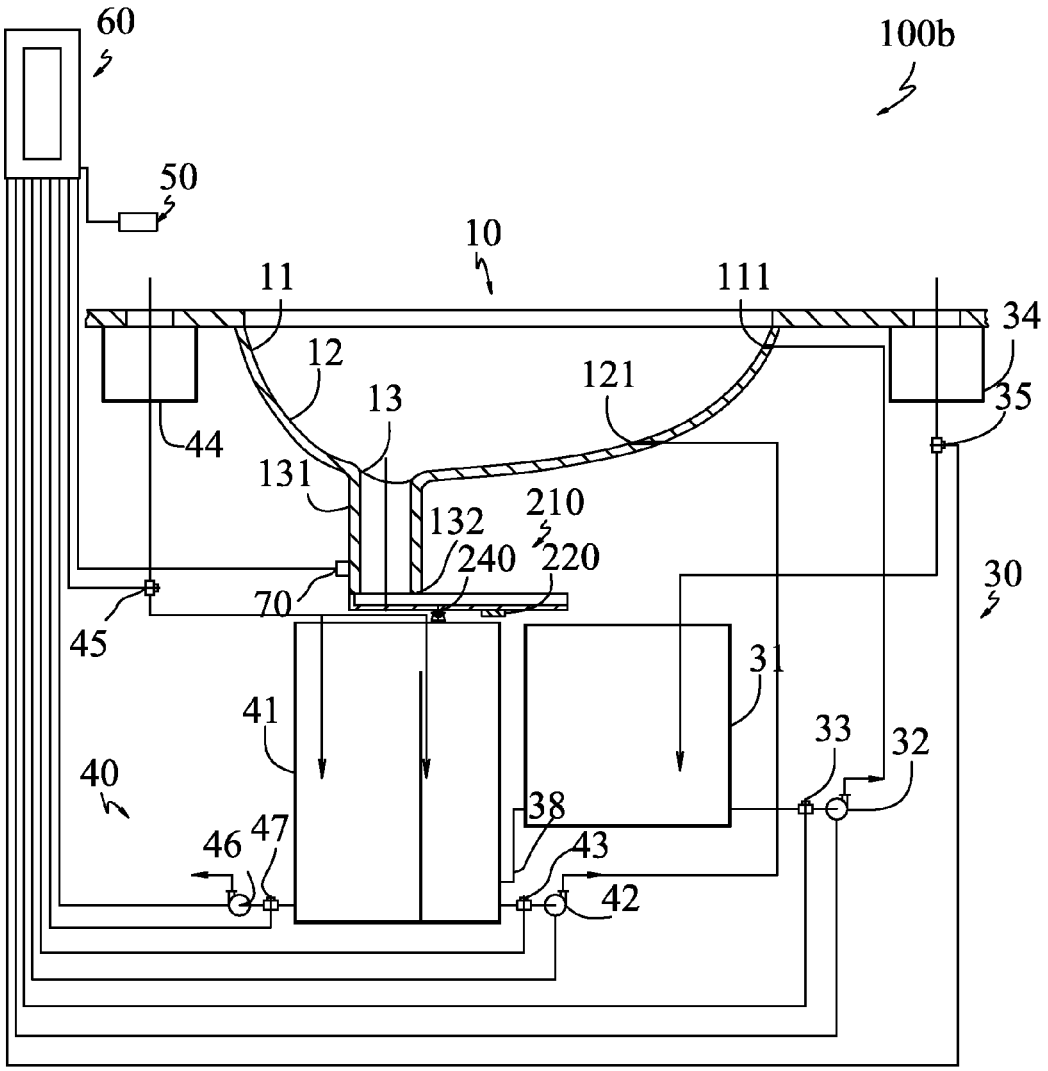
FIG. 8 is the longitudinal section diagrammatic sketch of the second embodiment of the first kind of lavatory pan device for stool and urine of the non-water lavatory flushing device in the situation of urine of the invention.

Or as shown in FIG. 8, the non-water lavatory flushing device 100*b*, the second embodiment of the first kind of lavatory pan device 200 for stool and urine of the invention, the stool and urine tray device 10 is mounted at the lower of the stool discharging tube 131. The part end surface of the lower end of the stool discharging tube 131 could closely touch with the part guard rib 212 of the stool and urine tray 210. Thus, a ring groove is set at the end surface of the lower end of the stool discharging tube 131 and a lock ring is set in the ring groove. The stool and urine tray condition detector 70, for example, a position switch, is mounted on the stool discharging tube 131 of the lavatory pan 10. Except the prescribed content in this paragraph, the structure of the non-water lavatory flushing device 100*b*, the second embodiment of the first kind of lavatory pan device 200 for stool and urine of the invention shown in FIG. 8 is same with the non-water lavatory flushing device 100*a*, the first embodiment of the first kind of lavatory pan device 200 for stool and urine of the invention shown in FIG. 7*a* and FIG. 7*b*.

Referring to FIG. 7*a* and FIG. 7*b*, the upper flushing liquid flushing device 30 consists of an upper flushing liquid box 31, an upper flushing liquid flushing pump 32, an upper flushing liquid electric control valve 33, a deodorant liquid pot 34 and the first deodorant liquid electric valve 35. The inlet of the upper flushing liquid flushing pump 32 is connected with the inner of the upper flushing liquid box 31 through a pipeline and the upper flushing liquid electric control valve 33 is mounted on the said pipeline. The outlet upper flushing liquid flushing pump 32 is connected with the upper flushing outlet 111 of the lavatory pan 10 by a pipeline. The inner of the deodorant liquid pot 34 is connected with the inner of the upper flushing liquid box 31 by a pipeline and the first deodorant liquid electric valve 35 is set on the said pipeline. The upper flushing liquid box 31 is at the lower of the outlet 213 of the stool and urine tray 210.

Referring to FIG. 7*a* and FIG. 7*b*, the middle flushing liquid flushing device 40 includes a stool collecting box 41, a middle flushing liquid flushing pump 42, a middle flushing liquid electric control valve 43, a deodorant liquid pot 44, a second deodorant liquid electric control valve 45, a stool discharging pump 46 and a row of stool discharging electric control valves 47. The inlet of the middle flushing liquid flushing pump 42 is connected with the inner of the stool collecting box 41 through a pipeline and the middle flushing liquid electric control valve 43 is mounted on the said pipeline. The outlet of the middle flushing liquid flushing pump 42 is connected with the middle flushing outlet 121 of the lavatory pan 10 by a pipeline. The inner of the deodorant liquid pot 44 is connected with the inner of the stool collecting box 41 through a pipeline and the second deodorant liquid electric control valve 45 is set on the said pipeline. The inlet of the stool discharging pump 46 is connected with the inner of stool and urine storage and transportation pot (not shown in the FIG.) by a pipeline. The stool collecting box 41 is at the lower part of the other said of the outlet 213 of the stool and urine tray 210. A filter board 415 is mounted in the stool collecting box 41. The stool liquid of the stool and urine dropping into one said of the filter board 415 will enter into the other said of the board 415 through the small holes in the filter board 415 and it will have the chemical reaction with the environmental protection medicine liquid as prescribed bellow and the middle flushing liquid without off-flavor will be produced. The pipeline connecting with inlet of the middle flushing liquid flushing pump 42 is connected with the inner of one said of the stool collecting box 41 filling with the middle flushing liquid. And the pipeline connecting with the inlet of stool discharging pump 46 is connected with the inner of one side of the stool collecting box 41 with the stool and urine.

Referring to FIG. 7*a* and FIG. 7*b*, the human detective device 50 is set at the suitable position in the lavatory and is used for changing the detected signal of users entering and leaving the non-water flushing lavatory 100*a* into electric signal and then transmits it to the circuit control device 60.The human body detective device 50 can be a photoelectric detective device set in the lavatory or passive human body infrared detective device, also could be a pressure transmitter mounted under the floorboard of the lavatory. And it also could be a travel switch mounted on the lock or inserted pin of the lavatory door or other kinds of detective device unless it the state of the detective device could illustrate if there is a person in the lavatory or not. For example, as a user enters into the lavatory, the human body will obstruct or reflect the light sent by the photoelectric detective device and this will change the state of the photoelectric detective device. When the user steps on the board of the lavatory, the state of the pressure transmitter mounted under the floorboard of the lavatory will be changed. When the user locks or inserts the door, the state of the travel switch will be changed. All the above working states of the detective device could illustrate if someone is using the non-water flushing lavatory 100*a*.

Referring to FIG. 7*a* and FIG. 7*b*, the circuit control device 60 is a common SCM. The circuit control device 60 is connected with the stool and urine tray state detector 70, the upper flushing liquid flushing pump 32, the upper flushing liquid electric control valve 33, the first deodorant liquid electric control valve 35, the middle flushing liquid flushing pump 42, the middle flushing liquid electric control valve 43, the second deodorant liquid electric control valve 45, the stool discharging pump 46, the stool discharging electric control valve 47 and the human body detective device 50.

Referring to FIG. 7*a* and FIG. 7*b*, when the user enters into the non-water flushing lavatory 100*a*, the circuit control device 60 receives the beginning signal of using sent by the human body detective device 50 and records it. When the user is peeing, the urine will flow into the stool and urine tray 210 through the stool discharging tube 131 of the lavatory pan 10 and will flow into the upper flushing liquid box 31 from the outlet 213 of the stool and urine tray 210. If the user finishes and leaves the non-water flushing lavatory 100*a*, the circuit control device 60 will receive the end signal sent by the human body detective device 50 and it will let the first deodorant liquid electric control valve 35 open and the environmental protection medicine liquid will flow from the deodorant liquid pot 34 into the upper flushing liquid box 31 through the pipeline. The environmental protection medicine liquid will mix with the urine in the upper flushing liquid box 31 and have chemical reaction with it. Then the off-flavor upper flushing liquid will be produced. When the first deodorant liquid electric control valve 35 opens, it will delay for a certain time and then close. The upper flushing liquid electric control valve 33 and the upper flushing liquid flushing pump 32 open and start at the same time. The upper flushing liquid in the upper flushing liquid box 31 enters into the upper flushing liquid flushing pump 32 through the pipeline and it will be compressed by the upper flushing liquid flushing pump 32 and will fly out from the upper flushing outlet 111 of the lavatory pan 10 through the pipeline and it can flush the lavatory pan 10. Finally, the upper flushing liquid will flow back into the upper flushing liquid box 31 and the upper flushing liquid electric control valve 33 and the upper flushing liquid flushing pump 32 will open and start, and will delay for a certain time and then will close and stop at the same time.

When the user defecates, usually with peeing, the urine will flow into the stool and urine tray 210 through the stool discharging tube 131 of the lavatory pan 10 and it will flow into the upper flushing liquid box 31 through the outlet 213 of the stool and urine tray 210. The stool and urine drops into the stool and urine tray 210 through the stool discharging tube 131 of the lavatory pan 10. When the amount of stool and urine dropping into the stool and urine tray 210 reaches a certain weight, the counterclockwise moment produced by the weight of the stool and urine corresponding with the center line of the axis 240 is bigger than the clockwise moment produced by the balance weight block 220 corresponding with the center line of the axis 240, the stool and urine tray 210 will rotate counterclockwise around the center line of the axis 240 as shown in FIG. 7*b*, and this makes the stool and urine dropping into the stool and urine tray 210 slide into one side of the inner of the stool collecting box 41 filling with stool and urine. When the stool and urine tray 210 rotates counterclockwise around the center line of the axis 240 as shown in FIG. 7*b*, the stool and urine tray state detector 70 will send the signal that the user is defecating to the circuit control device 60 and record it. After the stool and urine dropping into the stool and urine tray 210 slides into one side of the inner of the stool collecting box 41 filling with stool and urine, the balance weight block 220, the clockwise moment produced by the balance weight block 220 corresponding with the center line of the axis 240 makes the stool and urine tray 210 as shown in FIG. 7*a* and FIG. 7*b* roll over around the center line of the axis 240 clockwise. As the stool and urine tray 210 rotates back to the original position, the stool and urine tray state detector 70 will send the single that the user is in the first defecating and peeing to the circuit control device 60 and record the above signal. When the user is in the next defecating and peeing, the above procedure will be repeated. As the user finishes and leaves the non-water flushing lavatory 100*a*, the circuit control device 60 will receive the signal of ending sent by the human body detective device 50 and firstly, it will order the second deodorant liquid electric control valve 45 to open. The environmental protection medicine liquid will flow from the deodorant liquid pot 44 into two sides of the filter board 415 of the stool collecting box 41 through the pipeline. One side is stool and the other side is stool liquid. The environmental protection medicine liquid will have chemical reaction with the stool and urine, and the odor will be removed. The environmental protection medicine liquid has chemical reaction with the stool liquid, the reactant will be the middle flushing liquid without odor. The second deodorant liquid electric control valve 45 will start and delay for a certain time and then will close. After that, the middle flushing liquid electric control valve 43 and the middle flushing liquid flushing pump 42 will open and start at the same time, the middle flushing liquid will enter into the middle flushing liquid flushing pump 42 by the pipeline and it will be compressed by the middle flushing liquid flushing pump 42 and will fly out from the middle flushing outlet 121 of the lavatory pan 10 through the pipeline and it can flush the lavatory pan 10. Finally, the middle flushing liquid will flow back into the upper flushing liquid box 31 and the middle flushing liquid electric control valve 43 and the middle flushing liquid flushing pump 42 will open and start, and delay for a certain time and then will close and stop at the same time. Finally, the upper flushing liquid electric control valve 33 and the upper flushing liquid flushing pump 32 open and start at the same time. The upper flushing liquid in the upper flushing liquid box 31 enters into the upper flushing liquid flushing pump 32 through the pipeline and it will be compressed by the upper flushing liquid flushing pump 32 and will fly out from the upper flushing outlet 111 of the lavatory pan 10 through the pipeline and it can flush the lavatory pan 10. Finally, the upper flushing liquid will flow back into the upper flushing liquid box 31 and the upper flushing liquid electric control valve 33 and the upper flushing liquid flushing pump 32 will open and start, and will delay for a certain time and then will close and stop at the same time.

A communicating pipe 38 connects the lower part of the upper flushing liquid box 31 with the lower part of the no stool and urine side of the stool collecting box 41.

A liquid level sensor (not shown in FIG.) can be set at the upper flushing liquid box 31 and the stool collecting box 41. The said sensor should be connected with the circuit control device 60 electrically. When the liquid level of the upper flushing liquid box 31 or the stool collecting box 41 exceeds the specified value, the circuit control device 60 orders the stool discharging electric control valve 47 and the stool discharging pump 46 open and start together. The stool and urine enters into the stool and urine storage and transportation pot by pipeline. When the liquid level of the upper flushing liquid box 31 or the stool collecting box 41 falls to the described specified value, the circuit control device 60 orders the stool discharging electric control valve 47 and the stool discharging pump 46 to close and stop together.

The above content describes a kind of all automatic non-water lavatory flushing device 100*a* of the invention.

When no all automatic demands for non-water lavatory flushing device 100*a* is needed, the circuit control device 60, the human body detective device 50, the stool and urine tray state detector 70, the upper flushing liquid electric control valve 33, the middle flushing liquid electric control valve 43, the stool discharging pump 46 and the stool discharging electric control valve 47 could be canceled. The users could start or stop the upper flushing liquid flushing pump 32 and the middle flushing liquid flushing pump 42 by correspondingly opening or closing the first deodorant liquid electric valve 35 and the second deodorant liquid electric valve 45 with the common electric switch. Before leaving the non-water flushing lavatory 100*a* after using, the flushing of the lavatory 10 should be finished.

The described upper flushing liquid flushing pump 32, the middle flushing liquid flushing pump 42 and the stool discharging pump 46 are electric centrifugal pumps or electric plunger pumps. When no demands of automatic for the non-water flushing lavatory 100*a* is needed, not only the circuit control device 60, the human body detective device 50, the stool and urine tray state detector 70, the upper flushing liquid electric control valve 33, the middle flushing liquid electric control valve 43, the stool discharging pump 46 and the stool discharging electric control valve 47 could be canceled, but also the common electric switch could not be used. Use the public known foot pump to replace the above upper flushing liquid flushing pump 32 and the middle flushing liquid flushing pump 42 and use the public known hand valve to replace the first deodorant liquid electric valve 35 and the second deodorant liquid electric valve 45. Before leaving the non-water flushing lavatory 100*a* after using, the user should operate the foot pump replacing the above upper flushing liquid flushing pump 32 and the middle flushing liquid flushing pump 42 and the hand valve replacing the first deodorant liquid electric valve 35 and the second deodorant liquid electric valve 45 to finish the flushing of the lavatory pan 10.

The outlet pipeline of the upper flushing liquid flushing pump 32 could be connected with the outlet pipeline of the middle flushing liquid flushing pump 42, and then connected with the upper flushing outlet 111 or the middle flushing outlet 121 of the lavatory pan 10. This makes the middle flushing liquid and the upper flushing liquid flush only by the upper flushing outlet 111 or the middle flushing outlet 121 of the lavatory pan 10.

An extension spring (not shown in the FIG.) could be used to replace the balance weight block 220 to produce the moment. One end of the extension spring is mounted at the position for setting the balance weight block 220 and is connected with the stool and urine tray 210. The other end of the extension spring is connected at the top of the stool collecting box 41.

The balance weight block 220 could be replaced by matching a permanent magnet with an iron block to produce the moment. The iron block is mounted at the position where the balance weight block 220 is set and the said permanent magnet is set at the top of the stool collecting box 41.

The stool and urine tray state detector 70 can be a travel switch or a photoelectric detector.

Figure 9:
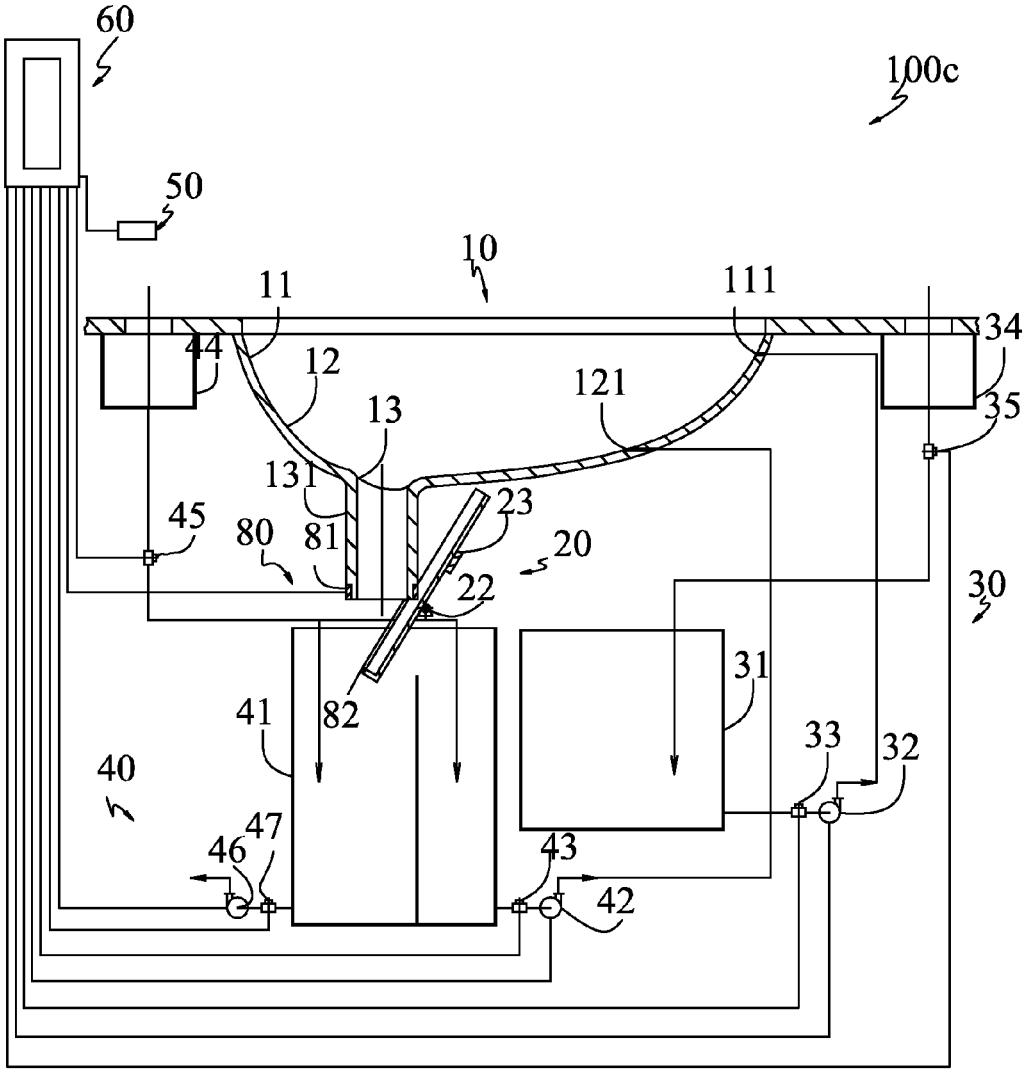
FIG. 9 is the longitudinal section diagrammatic sketch of the third embodiment of the first kind of lavatory pan device for stool and urine of the non-water lavatory flushing device in the situation of stool of the invention.

As shown in FIG. 9, the non-water lavatory flushing device 100*c*, the third embodiment of the first kind of lavatory pan device 200 for stool and urine of the invention has almost the same structure with the non-water lavatory flushing device 100*a* as shown in FIGS. 7*a* and 7*b*. The difference of them is the stool and urine tray state detector 70 including in the non-water lavatory flushing device 100*a* is replaced by a stool and urine tray releasing device 80 of the non-water lavatory flushing device 100*c*.

The stool and urine tray releasing device 80, for example, could be a electromagnetic device. As shown in FIG. 9, the electromagnetic device includes a magnetic coil 81 and a circular iron plate 82. The magnetic coil 81 is mounted at the lower part of the stool discharging tube 131 of lavatory pan 10 and is connected with the circuit control device 60 electrically. The circular iron plate 82 is set at the guard rib 212 of the stool and urine tray 210. The circular iron plate 82 also could be set in the flat plate (not shown in the FIG.) 211 of the stool and urine tray 210 and it is opposite to the lower end of the stool discharging tube 131 of lavatory pan 10.

As the above prescription, when the user defecates, usually with peeing, the urine will flow into the stool and urine tray 210 through the stool discharging tube 131 of the lavatory pan 10 and it will flow into the upper flushing liquid box 31 through the outlet 213 of the stool and urine tray 210. The stool and urine drops into the stool and urine tray 210 through the stool discharging tube 131 of the lavatory pan 10. At the time, the stool and urine tray releasing device 80 is in the state of non-releasing, that means the current flows from the magnetic coil 81 and the electromagnetic field produced by the magnetic coil 81 has the enough attractive power to the circular iron plate 82. Although the amount of the stool and urine dropping in the stool and urine tray 210 has reached to a certain weight, the counterclockwise moment produced by the weight of stool and urine corresponding to the center line of axis 22 is bigger than the clockwise moment produced by the balance weight block 23 corresponding to the center line of axis 22, and the stool and urine tray 210 still keeps in the level condition, as shown in FIG. 7*a*.

As the user finishes and leaves the non-water flushing lavatory 100*c*, the circuit control device 60 will receive the signal of ending sent by the human body detective device 50. Firstly, the circuit control device 60 will order the magnetic coil 81 to stop supplying electricity. As the weight of stool and urine dropping in the stool and urine tray 210 reaches a certain amount, the counterclockwise moment produced by the weight of stool and urine corresponding to the center line of axis 22 is bigger than the clockwise moment produced by the balance weight block 23 corresponding to the center line of axis 22, the stool and urine tray 210 rotates around the center line of the axis 22 counterclockwise, as shown in FIG. 9. The stool and urine tray releasing device 80 will send the signal of the user defecating to the circuit control device 60 and record the above signal. At the same time, the circuit control device 60 orders the second deodorant liquid electric control valve 45 to open. The environmental protection medicine liquid will flow from the deodorant liquid pot 44 into two sides of the filter board 415 of the stool collecting box 41 through the pipeline. One side is stool and the other side is stool liquid. The environmental protection medicine liquid will have chemical reaction with the stool and urine, and the odor will be removed. The environmental protection medicine liquid has chemical reaction with the stool liquid, the reactant will be the middle flushing liquid without odor. The second deodorant liquid electric control valve 45 will start and delay for a certain time and then will close. After that, the middle flushing liquid electric control valve 43 and the middle flushing liquid flushing pump 42 will open and start at the same time, the middle flushing liquid will enter into the middle flushing liquid flushing pump 42 by the pipeline and it will be compressed by the middle flushing liquid flushing pump 42 and will fly out from the middle flushing outlet 121 of the lavatory pan 10 through the pipeline and it can flush the lavatory pan 10. Finally, the middle flushing liquid will flow back into the upper flushing liquid box 31 and the middle flushing liquid electric control valve 43 and the middle flushing liquid flushing pump 42 will open and start, and will delay for a certain time and then will close and stop at the same time. Finally, the upper flushing liquid electric control valve 33 and the upper flushing liquid flushing pump 32 open and start at the same time. The upper flushing liquid in the upper flushing liquid box 31 enters into the upper flushing liquid flushing pump 32 through the pipeline and it will be compressed by the upper flushing liquid flushing pump 32 and will fly out from the upper flushing outlet 111 of the lavatory pan 10 through the pipeline and it can flush the lavatory pan 10. Finally, the upper flushing liquid will flow back into the upper flushing liquid box 31 and the upper flushing liquid electric control valve 33 and the upper flushing liquid flushing pump 32 will open and start, and will delay for a certain time and then will close and stop at the same time.

Figure 10:
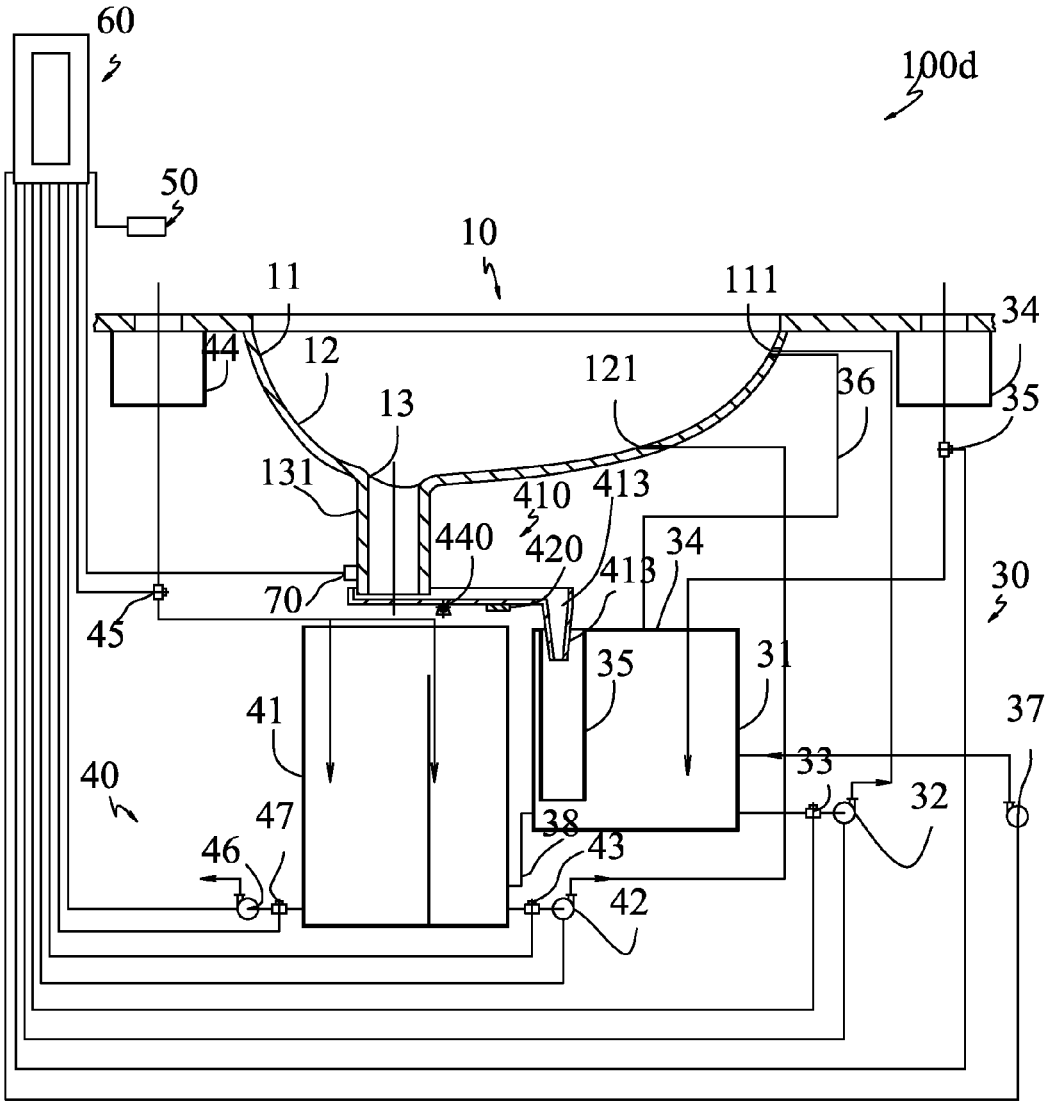
FIG. 10 is the longitudinal section diagrammatic sketch of the fourth embodiment of the third kind of lavatory pan device for stool and urine of the non-water lavatory flushing device in the situation of urine of the invention.

Referring to FIG. 10, the non-water lavatory flushing device 100*d*, as shown in FIG. 10, the fourth embodiment of the third kind of lavatory pan device 400 for stool and urine of the invention has almost the same structure with the non-water lavatory flushing device 100*a*, the first embodiment of the first kind of lavatory pan device 200 for stool and urine of the invention. Their difference is the non-water lavatory flushing device 100*d* uses the lavatory pan device 400 for stool and urine, but not the lavatory pan device 200. Thus, the upper flushing liquid box 31 has a head cover 311, which is connected with the top of the upper flushing liquid box 31 hermetically. A pipe 39 is set on the head cover 311 and its lower end extends to the bottom of the upper flushing liquid box 31. The lower end of the hopper 414 of the stool and urine tray 410 of the lavatory pan device 400 extends into the pipe 39. One end of the pipeline 36 is connected with the inner of the upper flushing liquid box 31 by the head cover 311 and the other end is connected with the upper flushing outlet 111 and/or the middle flushing outlet 121 of the lavatory pan 10. The outlet of the air pump 37 is connected with the inner of the upper flushing liquid box 31 at the lower part of box 31 through the pipeline. The circuit control device 60 is connected with the air pump 37.

When using the non-water lavatory flushing device 100*d*, there is the foam liquid produced by mixture of the deodorant liquid and the blister in the deodorant liquid pot 34. The deodorant foam liquid enters into the upper flushing liquid box 31 and has chemical reaction with the urine in it, thus a large amount of foam with no off-flavor liquid will be produced.

As the user only pees, the urine flows into the stool and urine tray 410 through the stool discharging tube 131 of the lavatory pan 10 and then flows into the upper flushing liquid box 31 from the entryway 413 of the stool and urine tray 410. As the user finishes and leaves the non-water lavatory flushing device 100*d*, the circuit control device 60 receives the signal of finishing sent by the human body detective device 50 and orders the first deodorant liquid electric valve 35 to open. This makes the deodorant foam liquid enters into the upper flushing liquid box 31 from the deodorant liquid pot 34 through the pipeline. The deodorant foam liquid mixes with the urine in the upper flushing liquid box 31 and have the chemical reaction. A large amount of foam with no off-flavor liquid will be produced in the upper of the upper flushing liquid box 31 and the upper flushing liquid without particular smell is in the lower of the upper flushing liquid box 31. After the first deodorant liquid electric valve 35 opens, it will delay for a certain time and then close. The air pump 37 starts, a large amount of air crosses the upper flushing liquid upwards and reaches the upper part of the upper flushing liquid box 31 and the large amount of foam full of no off-flavor liquid in the upper flushing liquid box 31 will be pressed into the pipe 36. The foam full of no off-flavor liquid will discharge into the lavatory pan 10 through the upper flushing outlet 111 of the lavatory pan 10 and the flushing of it could be realized. At the same time the inner surface of the lavatory pan 10 could be covered and lubricated. Finally, the liquid in the foam will still flow back into the upper flushing liquid box 31 and the air pump 37 will start and delay for a certain time and then stop.

The first deodorant liquid electric control valve 35 also could open, and it will delay for a certain time and then close. The upper flushing liquid electric control valve 33 and the upper flushing liquid flushing pump 32 open and start at the same time. The upper flushing liquid in the upper flushing liquid box 31 enters into the upper flushing liquid flushing pump 32 through the pipeline and it will be compressed by the upper flushing liquid flushing pump 32 and will fly out from the upper flushing outlet 111 of the lavatory pan 10 through the pipeline and it can flush the lavatory pan 10. Finally, the upper flushing liquid will flow back into the upper flushing liquid box 31 and the upper flushing liquid electric control valve 33 and the upper flushing liquid flushing pump 32 will open and start, and will delay for a certain time and then will close and stop at the same time. After that, the air pump 37 starts, a large amount of air crosses the upper flushing liquid upwards and reaches the upper part of the upper flushing liquid box 31 and the large amount of foam full of no off-flavor liquid in the upper flushing liquid box 31 will be pressed into the pipe 36. The foam full of no off-flavor liquid will discharge into the lavatory pan 10 through the upper flushing outlet 111 of the lavatory pan 10 and the flushing of it could be realized. At the same time the inner surface of the lavatory pan 10 could be covered and lubricated. Finally, the liquid in the foam will still flow back into the upper flushing liquid box 31 and the air pump 37 will start and delay for a certain time and then stop.

When the user defecates, usually with peeing, the urine will flow into the stool and urine tray 410 through the stool discharging tube 131 of the lavatory pan 10 and it will flow into the upper flushing liquid box 31 through the outlet 413 of the stool and urine tray 410. The stool and urine drops into the stool and urine tray 410 through the stool discharging tube 131 of the lavatory pan 10. When the amount of stool and urine dropping into the stool and urine tray 410 reaches a certain amount, the counterclockwise moment produced by the weight of the stool and urine corresponding with the center line of the axis 440 is bigger than the clockwise moment produced by the balance weight block 420 corresponding with the center line of the axis 440, the stool and urine tray 410 will rotate counterclockwise around the center line of the axis 440 as shown in FIG. 7*b*, and this makes the stool and urine dropping into the stool and urine tray 410 slide into one side filling with stool and urine of the inner of the stool collecting box 41. When the stool and urine tray 410 rotates counterclockwise around the center line of the axis 440, the stool and urine tray state detector 70 will send the signal that the user is defecating to the circuit control device 60 and record it. After the stool and urine dropping into the stool and urine tray 410 slides into one side of the inner of the stool collecting box 41 filling with stool and urine, the clockwise moment produced by the balance weight block 420 corresponding with the center line of the axis 440 makes the stool and urine tray 410 rotates around the center line of the axis 440 clockwise. As the to the stool and urine tray 410 rotates back to the original position, the stool and urine tray state detector 70 will send the single that the user is in the first defecating and peeing to the circuit control device 60 and record the above signal. When the user is in the next defecating and peeing, the above procedure will be repeated. As the user finishes and leaves the non-water flushing lavatory 100*d*, the circuit control device 60 will receive the signal of ending sent by the human body detective device 50 and firstly, it will order the first deodorant liquid electric control valve 35 to open. This makes the deodorant foam liquid enters into the upper flushing liquid box 31 from the deodorant liquid pot 34 through the pipeline. The deodorant foam liquid mixes with the urine in the upper flushing liquid box 31 and have the chemical reaction. A large amount of foam with no off-flavor liquid will be produced in the upper of the upper flushing liquid box 31 and the upper flushing liquid without particular smell is in the lower of the upper flushing liquid box 31. After the first deodorant liquid electric valve 35 opens, it will delay for a certain time and then close. The air pump 37 starts, a large amount of air crosses the upper flushing liquid upwards and reaches the upper part of the upper flushing liquid box 31 and the large amount of foam full of no off-flavor liquid in the upper flushing liquid box 31 will be pressed into the pipe 36. The foam full of no off-flavor liquid will discharge into the lavatory pan 10 through the upper flushing outlet 111 of the lavatory pan 10 and the flushing of it could be realized. At the same time the inner surface of the lavatory pan 10 could be covered and lubricated. Finally, the liquid in the foam will still flow back into the upper flushing liquid box 31 and the air pump 37 will start and delay for a certain time and then stop.

The first deodorant liquid electric control valve 35 also could open, and it will delay for a certain time and then close. The upper flushing liquid electric control valve 33 and the upper flushing liquid flushing pump 32 open and start at the same time. The upper flushing liquid in the upper flushing liquid box 31 enters into the upper flushing liquid flushing pump 32 through the pipeline and it will be compressed by the upper flushing liquid flushing pump 32 and will fly out from the upper flushing outlet 111 of the lavatory pan 10 through the pipeline and it can flush the lavatory pan 10. Finally, the upper flushing liquid will flow back into the upper flushing liquid box 31 and the upper flushing liquid electric control valve 33 and the upper flushing liquid flushing pump 32 will open and start, and will delay for a certain time and then will close and stop at the same time. After that, the air pump 37 starts, a large amount of air crosses the upper flushing liquid upwards and reaches the upper part of the upper flushing liquid box 31 and the large amount of foam full of no off-flavor liquid in the upper flushing liquid box 31 will be pressed into the pipe 36. The foam full of no off-flavor liquid will discharge into the lavatory pan 10 through the upper flushing outlet 111 of the lavatory pan 10 and the flushing of it could be realized. At the same time the inner surface of the lavatory pan 10 could be covered and lubricated. Finally, the liquid in the foam will still flow back into the upper flushing liquid box 31 and the air pump 37 will start and delay for a certain time and then will stop.

The invention claimed is

1. A no-water flushing device (100*a*) for separating stool from urine, including a pan (10), including an outlet (111), disposed at an upper part thereof, and a tube (131), with a lower end thereof set inside a tray (210), wherein a gap is formed between an upper surface of the plate (211) and an end surface of the lower end;

a device (200), including an axis (240), fixed to a bottom of the plate (211) and away from a passage;

the tray (210), including the plate (211), producing a counterclockwise torque $\tau 2$ relative to a central line of the axis (240) with solids received, a rib (212) inclining upwards and extending outwards from more than one edge of the plate (211), and the passage, placed on a side of the plate (211) where no rib (212) is formed to communicate an upper flusher (30), formed by an outlet (213), an elbow pipe (314) with a channel (313), or alternatively, a hopper (414) with a channel (413);

a weight (220), fixed to the bottom of the plate (211) and away from the axis (240) to produce a clockwise torque $\tau 1$ relative to the central line of the axis (240);

two support stands (230), rotatably supporting two ends of the axis (240);

the upper flusher (30), sits under a side of the tray (210) formed with the passage;

a middle flusher (40), sits under another side of the tray (210);

a body detector (50), converting non-electric signals detected to electric signals;

a circuit controller (60), receiving an initial signal and a final signal from the body detector (50), and i) activating a 1st deodorant valve (35) for a $1^{st}$ liquid medicine to flow into the upper flusher (30) to mix with urine contained therein in a chemical reaction in response to the final signal in detection of urine only, or otherwise, ii) activating a $2^{nd}$ deodorant valve (45) for a $2^{nd}$ liquid medicine to flow into the middle flusher (40) to mix with solids and urine contained therein in a chemical reaction;

a tray detector (70), mounted on the tube (131) for sending signals detected about the tray (210) to the circuit controller (60);

wherein when $\tau 2 > \tau 1$, the tray (210) pivotedly rotates counter-clockwise relative to the central line of the axis (24) to dispose the solids, while the tray detector (70) transmits information of a state of the tray to the circuit controller (60).

2. A no-water flushing device (100*a*) for separating stool from urine, including a pan (10), including an outlet (111), disposed at an upper part thereof, and a tube (131), with a lower end thereof set inside a tray (210), wherein an end surface of the lower end of the tube (131) closely contacts a rib (212) such that a ring groove with a lock ring is formed at the end surface of the lower end of the tube (131);

a device (200), including an axis (240), fixed to a bottom of the plate (211) and away from a passage;

the tray (210), including the plate (211), producing a counterclockwise torque $\tau 2$ relative to a central line of the axis (240) with solids received, and a rib (212) inclining upwards and extending outwards from more than one edge of the plate (211);

a weight (220), fixed to the bottom of the plate (211) and away from the axis (240) to produce a clockwise torque $\tau 1$ relative to the central line of the axis (240);

two support stands (230), rotatably supporting two ends of the axis (240);

the upper flusher (30), sits under a side of the tray (210) formed with the passage;

a middle flusher (40), sits under another side of the tray (210);

a body detector (50), converting non-electric signals detected to electric signals;

a circuit controller (60), receiving an initial signal and a final signal from the body detector (50), and i) activating a 1st deodorant valve (35) for a $1^{st}$ liquid medicine to flow into the upper flusher (30) to mix with urine contained therein in a chemical reaction in response to the final signal in detection of urine only, or otherwise, ii) activating a $2^{nd}$ deodorant valve (45) for a $2^{nd}$ liquid medicine to flow into the middle flusher (40) to mix with solids and urine contained therein in a chemical reaction;

a tray detector (70), mounted on the tube (131) for sending signals detected about the tray (210) to the circuit controller (60);

wherein when $\tau 2 > \tau 1$, the tray (210) pivotedly rotates counter-clockwise relative to the central line of the axis (24) to dispose the solids, while the tray detector (70) transmits information of a state of the tray (210) to the circuit controller (60).

3. A no-water flushing device (100*a*) for separating stool from urine, including a pan (10), including an outlet (111), disposed at an upper part thereof, and a tube (131), with a lower end thereof set inside a tray (410), wherein a gap is formed between an upper surface of the plate (411) and an end surface of the lower end;

a device (400), including an axis (440), fixed to a bottom of the plate (411) and away from a passage;

the tray (410), including the plate (411), producing a counterclockwise torque $\tau 2$ relative to a central line of the axis (440) with solids received, and a rib (412) inclining upwards and extending outwards from more than one edge of the plate (411), wherein an upper flusher box (31) has a head cover (311) connecting a top of the upper flusher box (31) hermetically, a pipe (39) is set on the head cover (311) with a lower end thereof extends to a bottom of the upper flusher box (31), a lower end of a hopper (414) of the tray (410) extends into the pipe (39), one end of a pipeline (36) connects an inner of the upper flusher box (31) by the head cover (311), and another end thereof connects an upper flusher outlet (111) and/or a middle flusher outlet (121), and an outlet of an air pump (37) connects the inner of the upper flusher box (31) at a lower section of the upper flusher box (31);

a weight (420), fixed to the bottom of the plate (211) and away from the axis (440) to produce a clockwise torque $\tau 1$ relative to the central line of the axis (440);

two support stands (230), rotatably supporting two ends of the axis (440);

the upper flusher (30), sitting under a side of the tray (410);

a middle flusher (40), sitting under another side of the tray (410);

a body detector (50), converting non-electric signals detected to electric signals;

a circuit controller (60), connecting the air pump (37), receiving an initial signal and a final signal from the body detector (50), and i) activating a 1st deodorant valve (35) for a $1^{st}$ liquid medicine to flow into the upper flusher (30) to mix with urine contained therein in a chemical reaction in response to the final signal in detection of urine only, or otherwise, ii) activating a $2^{nd}$ deodorant valve (45) for a $2^{nd}$ liquid medicine to flow into the middle flusher (40) to mix with solids and urine contained therein in a chemical reaction;

a tray detector (70), mounted on the tube (131) for sending signals detected about the tray (410) to the circuit controller (60);

wherein when $\tau 2 > \tau 1$, the tray (410) pivotedly rotates counter-clockwise relative to the central line of the axis (24) to dispose the solids, while the tray detector (70) transmits information of a state of the tray (410) to the circuit controller (60).

4. A no-water flushing device (100*a*) for separating stool from urine of claims 1 or 2, wherein the upper flusher (30) includes an upper flushing box (31), placed beneath the passage of the tray (210);

an upper flushing pump (32), with an inlet thereof connecting the upper flushing box (31) via a pipeline A, and an outlet connecting the upper flushing outlet 111 by a pipeline B;

an upper flushing control valve (33), fixed on the pipeline A;

a deodorant pot (34), connecting the upper flushing box (31) by a pipeline C; and the 1st deodorant valve (35), disposed on the pipeline C.

5. A no-water flushing device (100*a*) for separating stool from urine as in any one of claims 1-3, wherein the middle flusher (40) includes a box (41) with a filter board (415) of small holes, sits below the tray (210) but not under the outlet (213), providing a place for a chemical reaction to produce a middle flushing liquid;

a middle pump (42), with an inlet thereof connecting the box (41) via a pipeline a, an outlet thereof connecting the middle flushing outlet (121);

a middle control valve (43), fixed on the pipeline a;

a deodorant pot (44), connecting the box (41) via a pipeline b;

a second deodorant controller (45), disposed on the pipeline b;

a discharging pump (46);

a row of control valves (47);

wherein the pipeline a connecting the middle (42) also connects the box (41); a pipeline c connecting the discharging pump (46) also connects the box (41).

6. A no-water flushing device (100*a*) for separating stool from urine as in any one of claims 1-3, wherein the a body detector (50), converting detected signals into electric signals for transmission to the circuit controller (60), includes a photoelectric or an infrared detector, detecting a user, a pressure transmitter, sit under a floorboard of the lavatory, or a travel switch, fixed onto a door of the lavatory.

7. A no-water flushing device (100*a*) for separating stool from urine as in any one of claims 1-3, wherein the circuit controller (60) includes a SCM to connect the tray detector (70), the upper flushing pump (32), the upper flushing control valve (33), the 1st deodorant valve (35), the middle flushing pump (42), the middle flushing control valve (43), the $2^{nd}$ deodorant valve (45), the discharging pump (46), the control valves (47), and the body detector (50).

8. A no-water flushing device (100*a*) for separating stool from urine as in any one of claims 1-3, wherein the tray detector (70) is a position switch, or alternatively, an electromagnetic detector (80), including a magnetic coil (81), sitting at the lower part of the tube (131) and electrically connected to the circuit controller (60); and a circular iron plate (82), fixed to the rib (212).

9. A no-water flushing device (100*a*) for separating stool from urine as in any one of claims 1-3, wherein the weight (220) is an extension spring or a permanent magnet with an iron block.

10. A no-water flushing device (100*a*) for separating stool from urine as in any one of claims 1-3, wherein the axis (24) is integrated with the tray (210).

* * * * *